US011313361B2

(12) United States Patent
Teshima et al.

(10) Patent No.: US 11,313,361 B2
(45) Date of Patent: Apr. 26, 2022

(54) ROLLING DIAPHRAGM PUMP

(71) Applicant: NIPPON PILLAR PACKING CO., LTD., Osaka (JP)

(72) Inventors: Kazukiyo Teshima, Osaka (JP); Daisuke Urata, Osaka (JP)

(73) Assignee: NIPPON PILLAR PACKING CO., LTD., Osaka (JP)

( * ) Notice: Subject to any disclaimer, the term of this patent is extended or adjusted under 35 U.S.C. 154(b) by 0 days.

(21) Appl. No.: 16/963,138

(22) PCT Filed: Nov. 6, 2018

(86) PCT No.: PCT/JP2018/041230
§ 371 (c)(1),
(2) Date: Jul. 17, 2020

(87) PCT Pub. No.: WO2019/142455
PCT Pub. Date: Jul. 25, 2019

(65) Prior Publication Data

US 2021/0123429 A1 Apr. 29, 2021

(30) Foreign Application Priority Data

Jan. 19, 2018 (JP) ..... JP2018-007267

(51) Int. Cl.
*F04B 43/067* (2006.01)
*F04B 53/14* (2006.01)
(Continued)

(52) U.S. Cl.
CPC ..... *F04B 39/044* (2013.01); *F04B 43/0054* (2013.01); *F04B 43/06* (2013.01);
(Continued)

(58) Field of Classification Search
CPC ..... F04B 43/0054; F04B 43/0063; F04B 2201/0201; F04B 39/044; F04B 43/026;
(Continued)

(56) References Cited

U.S. PATENT DOCUMENTS 3,204,858 A * 9/1965 Dros ..... F04B 53/142 417/385
6,079,959 A 6/2000 Kingsford et al.
(Continued)

FOREIGN PATENT DOCUMENTS

JP 2000514525 A 10/2000
JP 2015098855 A 5/2015
WO WO-9802659 A1 * 1/1998 ..... F04B 43/0054

OTHER PUBLICATIONS

International Search Report PCT/JP2018/041230 dated Jan. 22, 2019 (1 page).

*Primary Examiner* — Dominick L Plakkoottam
(74) *Attorney, Agent, or Firm* — Millen, White, Zelano & Branigan, PC; Ryan Pool; William Nixon

(57) ABSTRACT

A rolling diaphragm pump that can inhibit an increase in cost with a simple configuration is provided. A rolling diaphragm pump 1 includes: a housing 2; a piston 3 disposed so as to be slidable relative to an inner peripheral surface of the housing 2 and reciprocatable in an axial direction; a rolling diaphragm 4 having a movable portion 41 disposed at one end portion in the axial direction of the piston 3 and reciprocatable together with the piston 3, a fixed portion 42 fixed to the housing 2, and a flexible connecting portion 43 connecting the movable portion 41 and the fixed portion 42 to each other; a pump chamber 5 defined by the rolling diaphragm 4 at one side in the axial direction within the housing 2 and into and from which a transport fluid is sucked and discharged by changing a volume of an interior of the pump chamber 5 by deformation of the connecting portion
(Continued)

43 due to reciprocation of the piston 3; and a working fluid chamber 6 defined by another end portion in the axial direction of the piston 3 at another side in the axial direction within the housing 2 and into and from which a working fluid is supplied and discharged, thereby causing the piston 3 to reciprocate.

5 Claims, 14 Drawing Sheets

(51) Int. Cl.

| | |
|---|---|
| ***F04B 39/04*** | (2006.01) |
| ***F04B 43/06*** | (2006.01) |
| ***F04B 45/053*** | (2006.01) |
| ***F04B 43/00*** | (2006.01) |
| ***F04B 45/04*** | (2006.01) |

(52) U.S. Cl.
CPC ..... *F04B 43/067* (2013.01); *F04B 45/04* (2013.01); *F04B 45/053* (2013.01); *F04B 53/14* (2013.01); *F04B 2201/0201* (2013.01)

(58) Field of Classification Search
CPC ..... F04B 43/06; F04B 43/067; F04B 45/053; F04B 53/14
See application file for complete search history.

(56) References Cited

U.S. PATENT DOCUMENTS

| | | | | |
|---|---|---|---|---|
| 2008/0260551 | A1* | 10/2008 | Simmons | F04B 45/043 417/394 |
| 2013/0259708 | A1 | 10/2013 | Du | |
| 2015/0300491 | A1* | 10/2015 | Teshima | F04B 43/04 92/48 |
| 2016/0273527 | A1 | 9/2016 | Teshima et al. | |

* cited by examiner

ROLLING DIAPHRAGM PUMP

TECHNICAL FIELD

The present invention relates to a rolling diaphragm pump.

BACKGROUND ART

For example, in a production process for a semiconductor, a liquid crystal device, an organic EL device, a solar cell, etc., a rolling diaphragm pump may be used as a pump for feeding a chemical solution when the chemical solution is applied or dispensed.

In such a type of rolling diaphragm pump, for example, as described in PATENT LITERATURE 1, the volume of a pump chamber (pressure chamber) sealed by a rolling diaphragm within a cylinder is changed by reciprocation of a piston housed within the cylinder, whereby a chemical solution is sucked into the pump chamber and discharged from the pump chamber.

The piston is connected to an electric motor as a drive source via a shaft and a ball screw which are disposed coaxially with the axis of the piston. Rotational motion of the electric motor is converted into linear motion by the ball screw, etc., thereby causing the piston to reciprocate.

CITATION LIST

Patent Literature

PATENT LITERATURE 1: Japanese Laid-Open Patent Publication No. 2015-98855

SUMMARY OF INVENTION

Technical Problem

The above rolling diaphragm pump requires the electric motor, which is a drive source, the ball screw for converting rotational motion of the electric motor into linear motion, etc. Thus, the structure is complicated, so that there is a problem that the rolling diaphragm pump is very costly. Particularly, when the discharge amount of the pump is increased, the size of the electric motor needs to be increased to obtain a required load, and thus the cost of the pump is significantly increased.

The present invention has been made in view of such circumstances, and an object of the present invention is to provide a rolling diaphragm pump that can inhibit an increase in cost with a simple configuration.

Solution to Problem

A rolling diaphragm pump according to the present invention includes: a housing; a piston disposed so as to be slidable relative to an inner peripheral surface of the housing and reciprocatable in an axial direction of the housing; a rolling diaphragm having a movable portion disposed at one end portion in the axial direction of the piston and reciprocatable together with the piston, a fixed portion fixed to the housing, and a flexible connecting portion connecting the movable portion and the fixed portion to each other; a pump chamber defined by the rolling diaphragm at one side in the axial direction within the housing and into and from which a transport fluid is sucked and discharged by changing a volume of an interior of the pump chamber by deformation of the connecting portion due to reciprocation of the piston; and a working fluid chamber defined by another end portion in the axial direction of the piston at another side in the axial direction within the housing and into and from which a working fluid is supplied and discharged, thereby causing the piston to reciprocate.

According to the present invention, the piston reciprocates when the working fluid is supplied into and discharged from the working fluid chamber, and the volume of the interior of the pump chamber is changed by deformation of the rolling diaphragm due to the reciprocation, whereby the transport fluid can be sucked and discharged. Accordingly, the electric motor, the ball screw, etc., in the conventional art are unnecessary, so that the rolling diaphragm pump can be made with a simple configuration, and an increase in cost can be inhibited.

Preferably, the piston has a sliding portion slidable relative to the inner peripheral surface of the housing, a closely-contacted portion having an outer peripheral surface with which the deformed connecting portion can be brought into close contact, and a connection portion connecting the sliding portion and the closely-contacted portion to each other, and the sliding portion, the closely-contacted portion, and the connection portion are formed as a single member.

In this case, since the sliding portion and the closely-contacted portion are integrally formed with the connection portion therebetween, the sliding portion and the closely-contacted portion do not need to be connected to each other by a connection means, and a locking portion for locking the connection means does not need to be provided to each of the sliding portion and the closely-contacted portion. Accordingly, occurrence of distortion in the sliding portion and the closely-contacted portion due to a load concentrated on the locking portions during reciprocation of the piston can be inhibited. In addition, since the sliding portion, the connection portion, and the closely-contacted portion are formed as a single member, the piston can be easily produced.

Advantageous Effects of Invention

According to the present invention, an increase in cost can be inhibited with a simple configuration.

DESCRIPTION OF EMBODIMENTS

Next, preferred embodiments of the present invention will be described with reference to the accompanying drawings.

Figure 1:
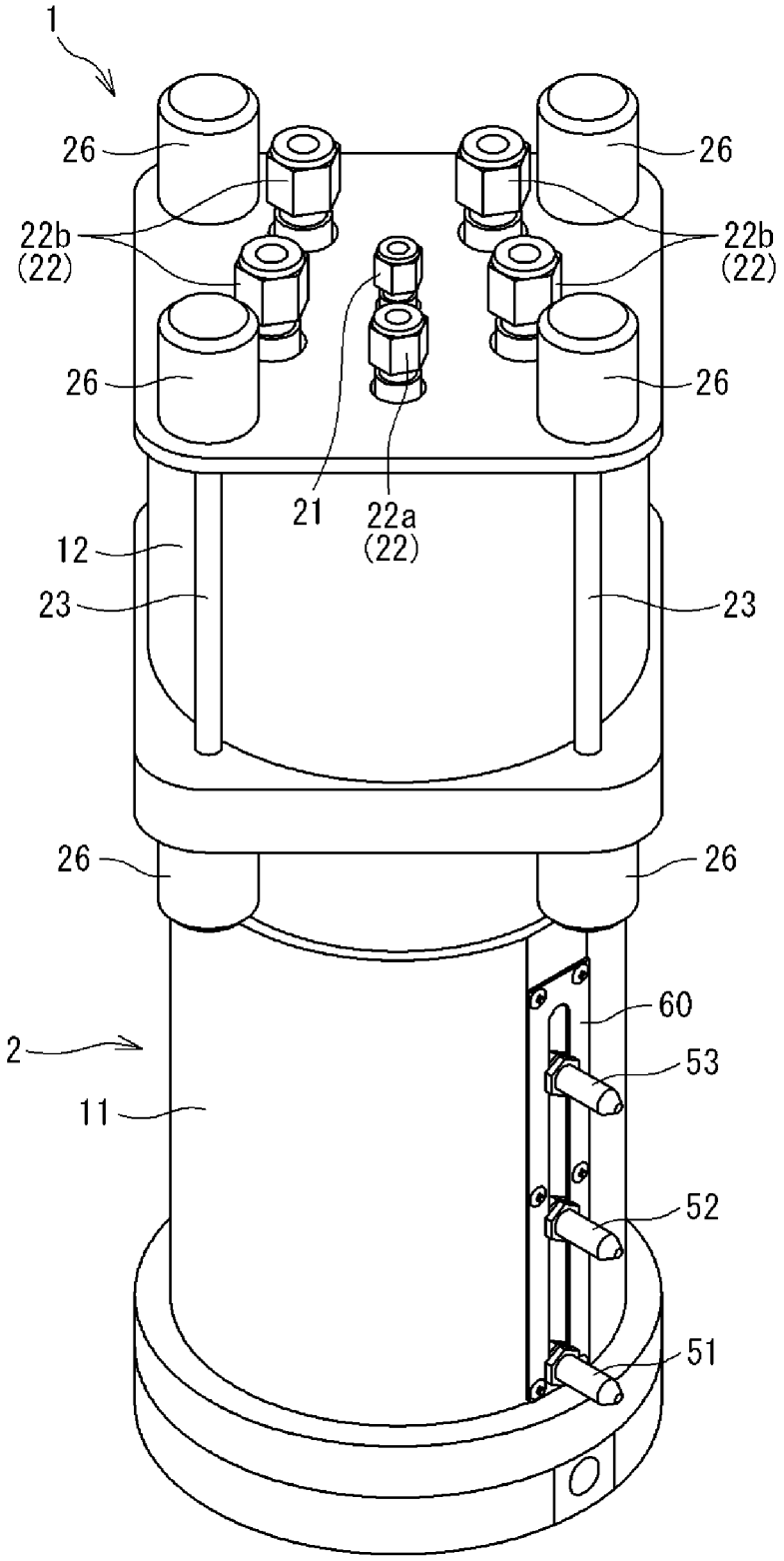
FIG. 1 is a perspective view of a rolling diaphragm pump according to an embodiment of the present invention.
Figure 2:
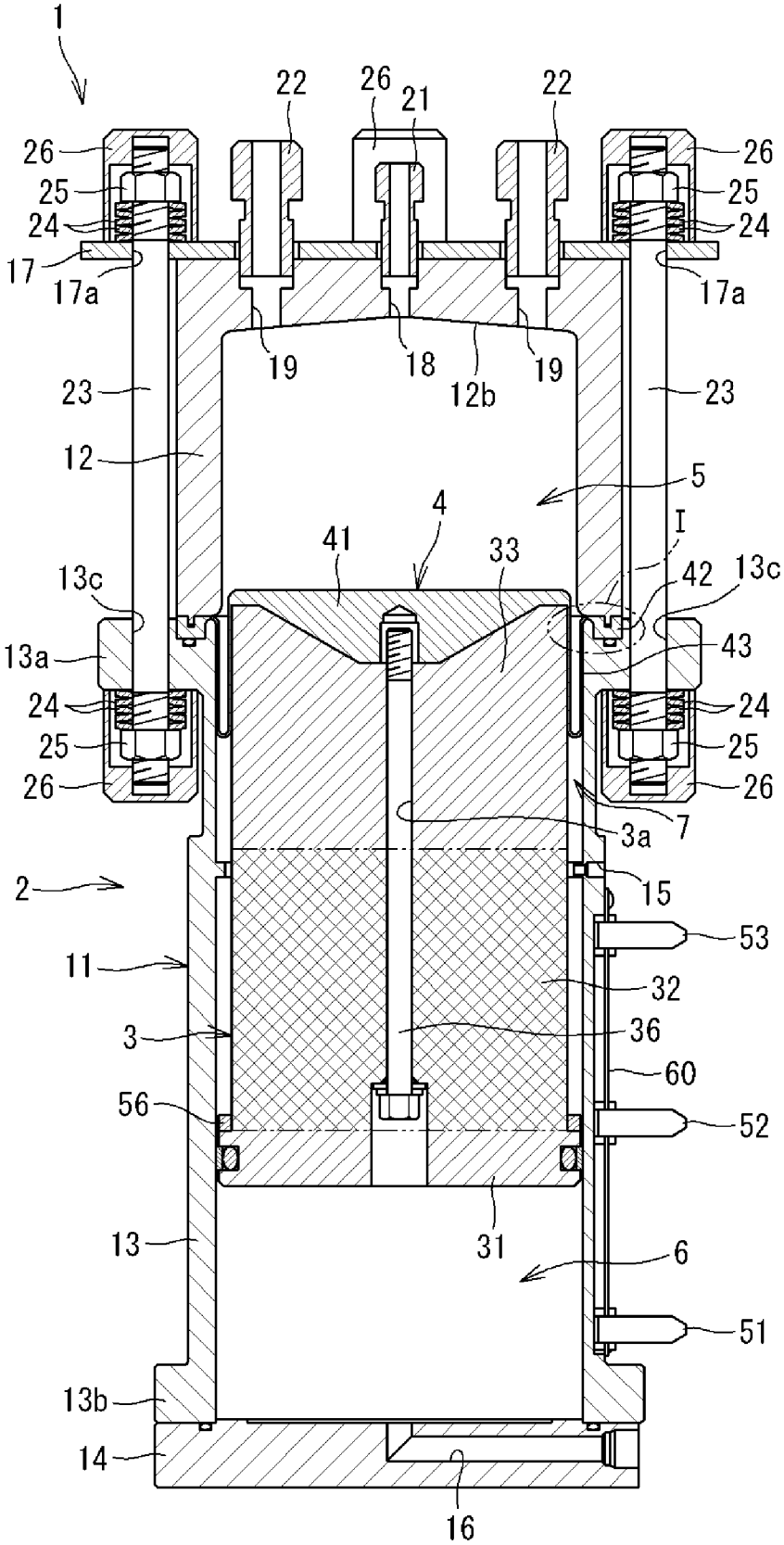
FIG. 2 is a cross-sectional view of the rolling diaphragm pump, showing a state where a piston is at a discharge end position.

FIG. 1 is a perspective view of a rolling diaphragm pump according to an embodiment of the present invention. FIG. 2 is a cross-sectional view of the rolling diaphragm pump. In FIG. 1 and FIG. 2, the rolling diaphragm pump 1 includes a housing 2, a piston 3, and a rolling diaphragm 4. In the present embodiment, the rolling diaphragm pump 1 (hereinafter, also referred to simply as pump 1) is placed such that the longitudinal direction (axial direction) thereof is the up-down direction, but may be placed such that the longitudinal direction (axial direction) thereof is a horizontal direction.

Configuration of Housing

The housing 2 has a cylinder 11 and a pump head 12. The cylinder 11 has a cylinder body 13 formed in a cylindrical shape, and a bottom plate 14 having a disc shape and fixed to a lower end in the axial direction of the cylinder body 13. The cylinder body 13 and the bottom plate 14 are formed, for example, from a metal such as aluminum.

The cylinder body 13 has a first flange portion 13*a* integrally formed at the outer periphery of an upper end portion thereof in the axial direction, and a second flange portion 13*b* integrally formed at the outer periphery of a lower end portion thereof in the axial direction.

The outer shape of the first flange portion 13*a* is formed, for example, as a regular quadrangle shape, and an insertion hole 13*c* is formed at each of the four corners of the first flange portion 13*a* so as to penetrate in the thickness direction of the first flange portion 13*a* (the up-down direction). The second flange portion 13*b* is formed, for example, in an annular shape. A ventilation port 15 is formed in the cylinder body 13 so as to penetrate in the thickness direction of the cylinder body 13 (the right-left direction). A decompression device (not shown) such as a vacuum pump or an aspirator is connected to the ventilation port 15.

A supply/discharge port 16 for supplying and discharging pressurized air and decompressed air into and from the housing 2 is formed in the bottom plate 14. One end of the supply/discharge port 16 is open at a center portion of the upper surface of the bottom plate 14, and another end of the supply/discharge port 16 is open at the outer peripheral surface of the bottom plate 14. Although not shown, the other end of the supply/discharge port 16 is connected to either an air supply device such as an air compressor that supplies pressurized air or a decompression device such as a vacuum pump or an aspirator that forcibly discharges pressurized air, by switching a valve.

The pump head 12 is formed from a fluorine resin such as polytetrafluoroethylene (PTFE) in a cylindrical shape with a lid. The pump head 12 is disposed on the upper surface of the first flange portion 13*a* of the cylinder body 13 so as to close the opening of the cylinder body 13. The pump head 12 has an inner diameter substantially equal to that of the cylinder body 13. Accordingly, the internal space of the pump head 12, together with the internal space of the cylinder body 13, forms a housing space in which the piston 3 can be housed.

A flange plate 17 formed from a metal (for example, stainless steel such as SUS304) is mounted on the upper end surface in the axial direction of the pump head 12. The flange plate 17 is formed, for example, in a regular quadrangle shape such that the outer shape of the flange plate 17 is substantially the same as that of the first flange portion 13*a* of the cylinder body 13. An insertion hole 17*a* is formed at each of the four corners of the flange plate 17 so as to penetrate in the thickness direction of the flange plate 17 (the up-down direction).

A single connection port 18 and a plurality of connection ports 19 are formed in an upper end portion in the axial direction of the pump head 12 so as to penetrate in the thickness direction of the pump head 12. The connection port 18 is used as a discharge port for discharging a liquid within a pump chamber 5 (described later) for purposes such as air release. The connection ports 19 are used as suction ports for sucking a liquid into the pump chamber 5 or as discharge ports for discharging a liquid from the pump chamber 5.

One end portion of a tubular connector 21 having external threads at both end portions thereof is mounted on the connection port 18 so as to penetrate the flange plate 17. A nut for fixing a tube inserted through the connector 21 is mounted on another end portion of the connector 21. Similarly, one end portion of a tubular connector 22 having external threads at both end portions thereof is mounted on each connection port 19 so as to penetrate the flange plate 17. A nut for fixing a tube inserted through the connector 22 is mounted on another end portion of the connector 22. In the present embodiment, five connection ports 19 and five connectors 22 are provided. The number of connection ports 18 (connectors 21) and the number of connection ports 19 (connectors 22) are not limited to those in the present embodiment. In addition, the method for connecting each tube is not limited to that in the present embodiment.

Although not shown, the connector 22 used as a suction port and mounted on the connection port 19 (for example, a connector 22*a* shown in FIG. 1) is connected via a tube, a valve, etc., to a liquid tank for storing a liquid (transport fluid) such as a chemical solution. Although not shown, the connector 22 used as a discharge port and mounted on the connection port 19 (for example, connectors 22*b* shown in FIG. 1) is connected via a tube, a valve, etc., to a liquid supply portion such as a spray nozzle for applying the liquid.

Configuration of Piston

The piston 3 is disposed so as to be slidable relative to the inner peripheral surface of the housing 2 and also disposed so as to be reciprocatable in the axial direction of the housing 2 (the up-down direction). The piston 3 is formed, for example, in a columnar shape as a single member made of a synthetic resin such as polypropylene (PP). A through hole 3*a* is formed in a center portion of the piston 3 so as to be coaxial with the axis of the piston 3 and penetrate in the axial direction.

The piston 3 of the present embodiment has, in order from the lower end thereof toward the upper end thereof in the axial direction, a sliding portion 31 (a hatched portion at the lower side in FIG. 2), a connection portion 32 (a cross-hatched portion in FIG. 2), and a closely-contacted portion 33 (a hatched portion at the upper side in FIG. 2). For convenience of description, in FIG. 2, the boundary between the sliding portion 31 and the connection portion 32 and the boundary between the connection portion 32 and the closely-contacted portion 33 are shown by imaginary lines (alternate long and two short dashes lines) (the same applies to FIG. 3, FIG. 4, FIG. 6, FIG. 8, FIG. 10, and FIG. 11).

Figure 3:
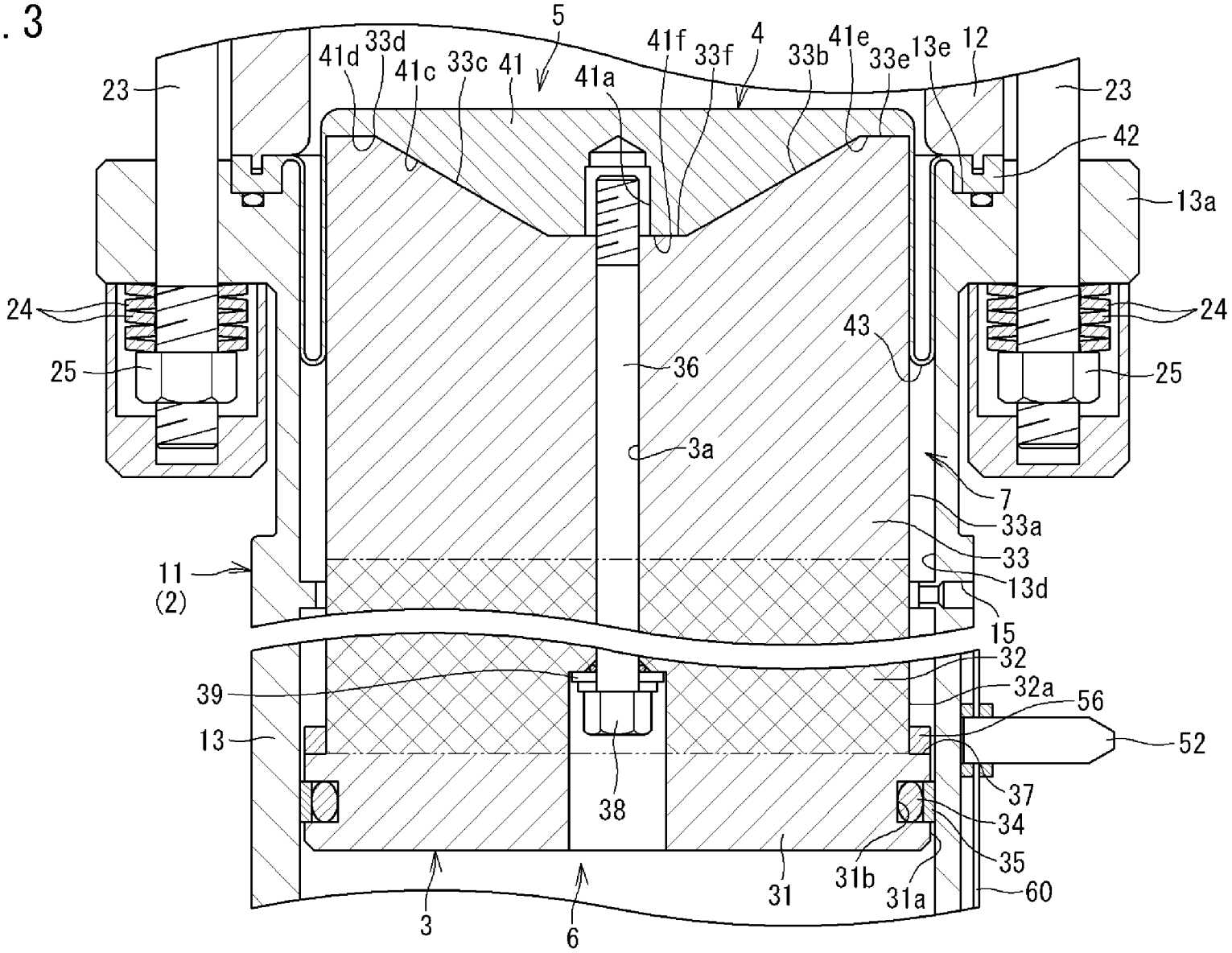
FIG. 3 is a partially enlarged cross-sectional view of the rolling diaphragm pump in FIG. 2.

FIG. 3 is a partially enlarged cross-sectional view of the pump 1 in FIG. 2. The sliding portion 31 of the piston 3 has an outer diameter slightly smaller than the inner diameter of the cylinder body 13, and a small annular gap is formed between an outer peripheral surface 31*a* of the sliding portion 31 and an inner peripheral surface 13*d* of the cylinder body 13.

An annular seal groove 31*b* is formed on the outer peripheral surface 31*a* of the sliding portion 31 over the entire periphery thereof, and an O-ring 34 is mounted in the seal groove 31*b*. The O-ring 34 is formed, for example, from a rubber material such as a fluorine rubber. A sliding ring 35 is mounted in the seal groove 31*b* at the outer side in the radial direction of the O-ring 34, and the gap between the sliding portion 31 and the sliding ring 35 is sealed by the elastic force of the O-ring 34 (also see FIG. 11). The outer diameter of the sliding ring 35 is set so as to be slightly larger than the inner diameter of the cylinder body 13. Thus, the outer peripheral surface of the sliding ring 35 slides while being pressed against the inner peripheral surface 13*d* of the cylinder body 13, whereby the gap between both peripheral surfaces is sealed, and a working fluid chamber 6 and a decompression chamber 7 described later can be separated from each other. The outer diameter of the seal groove 31*b* of the sliding portion 31 (the diameter of an outer peripheral surface that is the bottom surface of the seal groove 31*b*) is preferably substantially equal to each of the outer diameters of the connection portion 32 and the closely-contacted portion 33.

The closely-contacted portion 33 is a portion having an outer peripheral surface 33*a* with which a connecting portion 43 described later is brought into close contact. The closely-contacted portion 33 of the present embodiment has a smaller outer diameter than the sliding portion 31, and an annular gap is formed between the outer peripheral surface 33*a* of the closely-contacted portion 33 and the inner peripheral surface 13*d* of the cylinder body 13. In addition, the closely-contacted portion 33 is formed so as to be longer in the axial direction than the sliding portion 31 (see FIG. 2). A recess 33*b* is formed on the upper surface of the closely-contacted portion 33 so as to have a shape along the outer shape of the lower surface of a movable portion 41 described later.

The connection portion 32 is a portion integrally connecting the sliding portion 31 and the closely-contacted portion 33 to each other. The connection portion 32 of the present embodiment has an outer diameter equal to that of the closely-contacted portion 33, and an annular gap is formed between an outer peripheral surface 32*a* of the connection portion 32 and the inner peripheral surface 13*d* of the cylinder body 13. In addition, the connection portion 32 is formed so as to be longer in the axial direction than the closely-contacted portion 33 (see FIG. 2). The outer diameter of the connection portion 32 is preferably equal to the outer diameter of the closely-contacted portion 33.

The through hole 3*a* has a hole diameter that is slightly changed and increased at a lower portion in the axial direction of the connection portion 32 (see FIG. 3). A nut 38 screwed onto a rear end portion of a through bolt 36 is seated on a step surface of the diameter-changed portion of the through hole 3*a* with a washer 39 therebetween. A triangular groove is provided on the diameter-changed portion of the through hole 3*a* such that a part of the step surface of the diameter-changed portion is cut, and an O-ring is mounted in the triangular groove. Accordingly, the gap between the through hole 3*a* and the washer 39 is sealed, and communication in the up-down direction is blocked at the diameter-changed portion in the through hole 3*a*.

The sliding portion 31 and the closely-contacted portion 33 may be connected to each other by a connection means such as a rod that is a separate member, instead of the connection portion 32. However, in this case, a locking portion for locking the connection means (for example, a portion for screwing the rod) needs to be provided to each of the sliding portion 31 and the closely-contacted portion 33. Thus, during reciprocation of the piston 3, a load is concentrated on the locking portions respectively provided to the sliding portion 31 and the closely-contacted portion 33.

Therefore, when the pump 1 including the connection means and the locking portions is used over a long period of time, distortion may occur in the sliding portion 31 and the closely-contacted portion 33. Particularly, in the case where the sliding portion 31 and the closely-contacted portion 33 are formed from a resin material as in the present embodiment, the distortion easily occurs. When distortion occurs in the closely-contacted portion 33, the liquid discharge amount of the pump 1 may be changed. In addition, when distortion occurs in the sliding portion 31, the sealing performance by the O-ring 34 and the sliding ring 35 for sealing the gap between the outer peripheral surface of the sliding ring 35 and the inner peripheral surface 13*d* of the cylinder body 13 may be decreased.

On the contrary, in the present embodiment, since the sliding portion 31 and the closely-contacted portion 33 are integrally formed with the connection portion 32 therebetween, the connection means and the locking portions are unnecessary. Accordingly, occurrence of distortion in the sliding portion 31 and the closely-contacted portion 33 can be inhibited, so that a change in the liquid discharge amount of the pump 1 and a decrease in the sealing performance between the outer peripheral surface of the sliding ring 35 and the inner peripheral surface 13*d* of the cylinder body 13 can be effectively inhibited. In addition, since the sliding portion 31, the connection portion 32, and the closely-contacted portion 33 are formed as a single member, the piston 3 can be easily produced.

Configuration of Rolling Diaphragm

In FIG. 3, the rolling diaphragm 4 is formed from a fluorine resin such as PTFE and housed within the housing 2. The rolling diaphragm 4 has the movable portion 41 disposed on an upper end portion in the axial direction (one end portion in the axial direction) of the piston 3, an annular fixed portion 42 mounted to the housing 2, and the connecting portion 43 connecting the movable portion 41 and the fixed portion 42 to each other. The rolling diaphragm 4 is configured such that the movable portion 41 reciprocates, together with the piston 3, in the axial direction relative to the fixed portion 42 which is fixed in position by the housing 2.

The fixed portion 42 of the rolling diaphragm 4 is fitted into an annular recess 13*e* formed on the upper surface of the first flange portion 13*a* of the cylinder body 13, and is located between the cylinder body 13 and the pump head 12. In this state, as shown in FIG. 2, nuts 25 are each screwed onto both end portions of a through bolt 23, which is inserted through the insertion hole 17*a* of the flange plate 17 and the insertion hole 13*c* of the first flange portion 13*a*, with a predetermined number of disc springs 24 therebetween. The fixed portion 42 is strongly held between the joint surfaces of the cylinder body 13 and the pump head 12 and fixed to the housing 2 by tightening these nuts 25. Both end portions of each through bolt 23 are covered and protected together with the nut 25 and the predetermined number of disc springs 24 by a cap 26.

Referring back to FIG. 3, the movable portion 41 of the rolling diaphragm 4 has an outer diameter substantially equal to that of the closely-contacted portion 33 of the piston 3. The movable portion 41 of the present embodiment is formed in a truncated cone shape such that the diameter thereof gradually decreases toward the lower side, and is fitted into the recess 33*b* of the closely-contacted portion 33. Accordingly, the movable portion 41 is disposed coaxially with the piston 3.

A screw hole 41*a* is formed in the lower surface of the movable portion 41, and a front end portion of the through bolt 36 inserted through the through hole 3*a* of the piston 3 is screwed into the screw hole 41*a*. Accordingly, the movable portion 41 is fixed to the closely-contacted portion 33 of the piston 3, so that the movable portion 41 can be moved downward together with the piston 3 in a suction process described later.

The connecting portion 43 of the rolling diaphragm 4 connects the inner end in the radial direction of the fixed portion 42 and the outer end in the radial direction of the movable portion 41 to each other. In addition, the connecting portion 43 is formed thin (in a thin film shape) so as to have flexibility. Meanwhile, the movable portion 41 and the fixed portion 42 are formed sufficiently thicker than the connecting portion 43 so as to have rigidity.

In the state shown in FIG. 3, the connecting portion 43 is bent in a U cross-sectional shape between the inner peripheral surface 13*d* of the cylinder body 13 and the outer peripheral surface 33*a* of the closely-contacted portion 33. Specifically, the connecting portion 43 extends from the inner end in the radial direction of the fixed portion 42 toward the lower side in the axial direction along the inner peripheral surface 13*d* of the cylinder body 13, is folded to the inner side in the radial direction, and extends toward the upper side in the axial direction along the outer peripheral surface 33*a* of the closely-contacted portion 33 until reaching the movable portion 41. In this state, the connecting portion 43 is brought into close contact with the inner peripheral surface 13*d* of the cylinder body 13 and the outer peripheral surface 33*a* of the closely-contacted portion 33.

Figure 4:
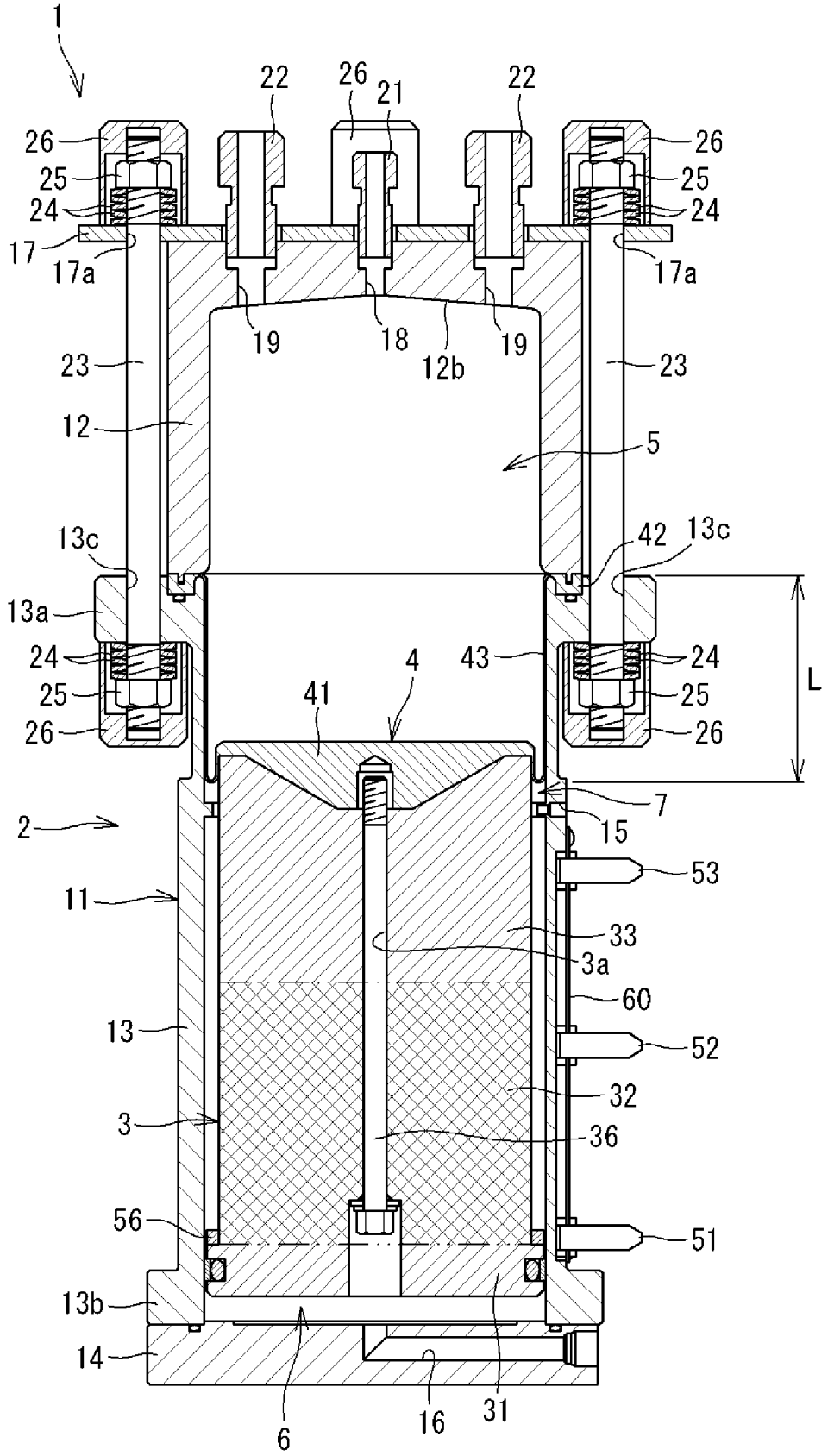
FIG. 4 is a cross-sectional view of the rolling diaphragm pump, showing a state where the piston is at a suction end position.

Moreover, when the piston 3 moves to a most retracted position shown in FIG. 4, the connecting portion 43 becomes deformed into a cylindrical shape along the inner peripheral surface 13*d* of the cylinder body 13, and most of the outer peripheral surface of the connecting portion 43 is brought into close contact with the inner peripheral surface 13*d*. Furthermore, when the piston 3 moves to a most advanced position shown in FIG. 10, the connecting portion 43 becomes deformed into a cylindrical shape along the outer peripheral surface 33*a* of the closely-contacted portion 33, and the entirety of the inner peripheral surface of the connecting portion 43 is brought into close contact with the outer peripheral surface 33*a*.

Chambers Defined within Housing

In FIG. 2, the pump chamber 5, the working fluid chamber 6, and the decompression chamber 7 are defined within the housing 2 of the pump 1 by the piston 3, the rolling diaphragm 4, etc.

The pump chamber 5 is defined by the rolling diaphragm 4 at the upper side in the axial direction (one side in the axial direction) within the housing 2 and formed such that the volume of the interior of the pump chamber 5 is changeable.

The pump chamber 5 of the present embodiment is formed by being surrounded by the movable portion 41 and the connecting portion 43 of the rolling diaphragm 4 and the pump head 12, and communicates with the connection port 18 and the connection ports 19. The volume of the interior of the pump chamber 5 is changed by reciprocation of the piston 3.

The working fluid chamber 6 is defined by a lower end portion in the axial direction (another end portion in the axial direction) of the piston 3 at the lower side in the axial direction (another side in the axial direction) within the housing 2. The working fluid chamber 6 communicates with the supply/discharge port 16. The piston 3 reciprocates in the housing 2 by supplying and discharging pressurized air and decompressed air (working fluid) into and from the working fluid chamber 6 using the air supply device and the decompression device connected via the supply/discharge port 16.

The decompression chamber 7 is defined between the pump chamber 5 and the working fluid chamber 6 within the housing 2 by the piston 3, the connecting portion 43 of the rolling diaphragm 4, and the cylinder body 13. The decompression chamber 7 communicates with the ventilation port 15. During drive of the pump 1, the pressure of the decompression chamber 7 is reduced to a predetermined pressure (negative pressure) by the decompression device connected via the ventilation port 15.

Method for Driving Pump

In the above configuration, a discharge process in which the piston 3 advances toward the upper side in the axial direction by supplying pressurized air into the working fluid chamber 6, and a suction process in which the piston 3 retracts toward the lower side in the axial direction by forcibly discharging pressurized air within the working fluid chamber 6 to the outside to reduce the pressure of the interior of the working fluid chamber 6, are repeatedly performed. Accordingly, a liquid stored in the liquid tank or the like can be supplied from the pump 1 to the liquid supply portion.

That is, in the suction process, the movable portion 41 of the rolling diaphragm 4 moves downward so as to follow the retraction of the piston 3 (changes from a state shown in FIG. 2 to a state shown in FIG. 4). In this process, the connecting portion 43 of the rolling diaphragm 4 rolls such that the bent position thereof is displaced downward, from a state where the connecting portion 43 is bent in the gap between the inner peripheral surface 13*d* of the cylinder body 13 and the outer peripheral surface 33*a* of the closely-contacted portion 33 to a state where most of the outer peripheral surface of the connecting portion 43 is brought into close contact with the inner peripheral surface 13*d* of the cylinder body 13. Accordingly, the volume of the pump chamber 5 is increased, so that the liquid within the liquid tank is sucked through the connection port 18 into the pump chamber 5.

Moreover, in the discharge process, the movable portion 41 of the rolling diaphragm 4 moves upward so as to follow the advancement of the piston 3 (changes from the state shown in FIG. 4 to the state shown in FIG. 2). In this process, the connecting portion 43 of the rolling diaphragm 4 rolls such that the bent position thereof is displaced upward, from the state where most of the outer peripheral surface of the connecting portion 43 is brought into close contact with the inner peripheral surface 13*d* of the cylinder body 13 to the state where the connecting portion 43 is bent in the gap between the inner peripheral surface 13*d* of the cylinder body 13 and the outer peripheral surface 33*a* of the closely-contacted portion 33. Accordingly, the volume of the pump chamber 5 is reduced, so that the liquid within the pump chamber 5 is discharged through the respective connection ports 19.

In the suction process and the discharge process, the pressure of the decompression chamber 7 is reduced to a predetermined pressure (negative pressure) by the decompression device connected via the ventilation port 15. Therefore, the connecting portion 43 of the rolling diaphragm 4 can be reliably brought into close contact with each of the inner peripheral surface 13*d* of the cylinder body 13 and the outer peripheral surface 33*a* of the closely-contacted portion 33.

Due to the above, the piston 3 reciprocates when pressurized air and decompressed air are supplied into and discharged from the working fluid chamber 6, and the volume of the interior of the pump chamber 5 is changed by deformation of the connecting portion 43 of the rolling diaphragm 4 due to the reciprocation, whereby the liquid can be sucked and discharged. Accordingly, the electric motor, the ball screw, etc., in the conventional art are unnecessary, so that the pump 1 can be made with a simple configuration, and an increase in cost can be inhibited.

In the present embodiment, in the suction process, decompressed air is supplied into the working fluid chamber 6 by the decompression device, but the supply/discharge port 16 of the working fluid chamber 6 may be opened to the atmosphere instead of supplying decompressed air, and the piston 3 may be caused to retract toward the lower side in the axial direction by using the pressure of the liquid within the pump chamber 5. In this case, the movable portion 41 of the rolling diaphragm 4 retracts together with the piston 3 by the pressure of the liquid, and thus the through bolt 36 for fixing the movable portion 41 to the piston 3 is unnecessary. In addition, the connecting portion 43 of the rolling diaphragm 4 can be brought into close contact with each of the inner peripheral surface 13*d* of the cylinder body 13 and the outer peripheral surface 33*a* of the closely-contacted portion 33 by the pressure of the liquid, and thus the decompression chamber 7 and the ventilation port 15 are also unnecessary.

Seal Structure of Housing

Figure 5:
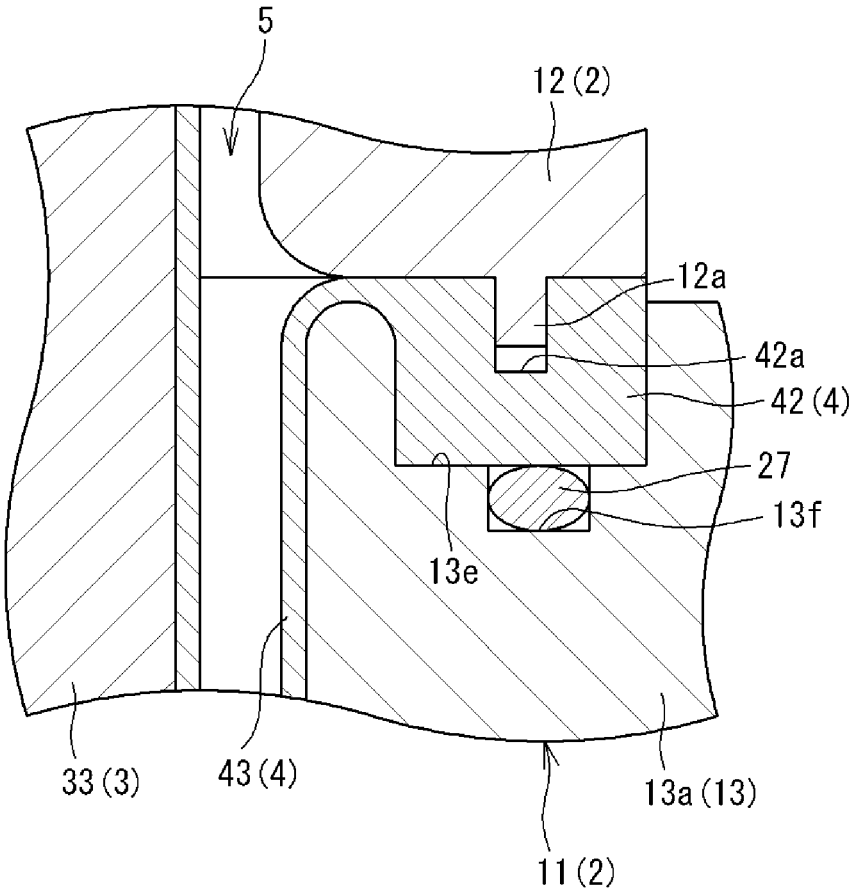
FIG. 5 is an enlarged cross-sectional view of a portion I in FIG. 2.

FIG. 5 is an enlarged cross-sectional view of a portion I in FIG. 2, and shows a seal structure between the joint surfaces of the cylinder body 13 and the pump head 12 of the housing 2. In FIG. 5, the fixed portion 42 of the rolling diaphragm 4 located between the joint surfaces of the cylinder body 13 and the pump head 12 has an annular groove 42*a* formed on the upper surface of the fixed portion 42.

An annular projection 12*a* formed on the lower surface of the pump head 12 so as to project therefrom is stuck into the groove 42*a*. By this stuck structure, the liquid within the pump chamber 5 is prevented from leaking through between the joint surfaces to the outside. A lip seal structure or an O-ring seal structure may be used instead of the stuck structure, or at least two of the stuck structure, a lip seal structure, and an O-ring seal structure may be used in combination.

In the first flange portion 13*a* of the cylinder body 13, an annular seal groove 13*f* is formed on the bottom surface of the recess 13*e*, and an O-ring 27 is mounted in the seal groove 13*f*. The O-ring 27 is formed, for example, from a rubber material such as a fluorine rubber and is pressed against the lower surface of the fixed portion 42. The decompression chamber 7 (see FIG. 2) is sealed by the O-ring 27. A lip seal or a gasket seal may be used instead of the O-ring 27, or at least two of the O-ring 27, a lip seal, and a gasket seal may be used in combination.

Structure for Mounting Proximity Sensors

In FIG. 1 and FIG. 2, a plurality of (three in the illustrated example) proximity sensors, for detecting a sliding position of the piston 3, including a first proximity sensor 51, a second proximity sensor 52, and a third proximity sensor 53 are mounted on the outer peripheral surface of the cylinder body 13 of the housing 2 with a mounting plate 60 therebetween.

The first proximity sensor 51 detects a position of the piston 3 at which the suction process is ended (a position in FIG. 4, hereinafter referred to as "suction end position"). On the basis of this detection, control of stopping retraction of the piston 3, control of stopping the retraction and starting advancement of the piston 3, or the like is performed. The suction end position of the piston 3 in the present embodiment is set to a position where the piston 3 has retracted to the most retracted position as shown in FIG. 4.

The second proximity sensor 52 detects a position of the piston 3 at which the discharge process is ended (a position in FIG. 2, hereinafter referred to as "discharge end position"). On the basis of this detection, control of stopping advancement of the piston 3, control of stopping the advancement and starting retraction of the piston 3, or the like is performed. The discharge end position of the piston 3 in the present embodiment is set to a position where the piston 3 has moved to a position near substantially the center in the axial direction within the housing 2 as shown in FIG. 2.

Figure 6:
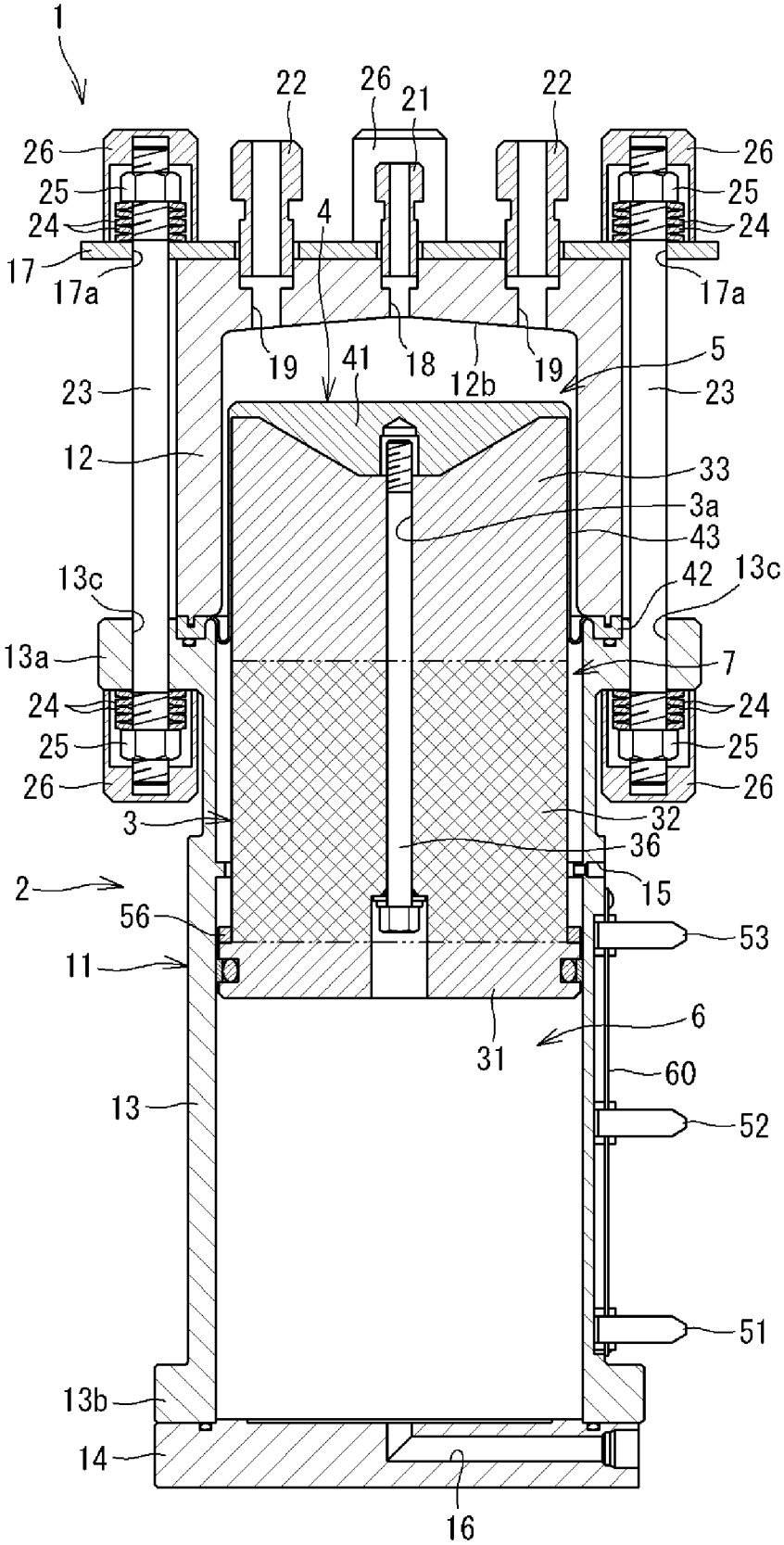
FIG. 6 is a cross-sectional view of the rolling diaphragm pump, showing a state where the piston is at a most-advanced-immediately-previous position.

The third proximity sensor 53 detects a position of the piston 3 immediately before the piston 3 advances to the most advanced position (see FIG. 10) (hereinafter, referred to as "most-advanced-immediately-previous position") as shown in FIG. 6. The third proximity sensor 53 is a proximity sensor for backup used when the piston 3 advances to above the discharge end position due to malfunction of the second proximity sensor 52 or the like. The amount of the liquid remaining in the pump chamber 5 can also be grasped by the proximity sensors 51 to 53 detecting the sliding position of the piston 3.

Each of the proximity sensors 51 to 53 is a magnetic proximity sensor, and detects the magnetism of an annular permanent magnet 56 (see FIG. 3) mounted on a lower end portion of the piston 3. In the present embodiment, one end surface in the axial direction (a left end surface in FIG. 8) of each of the proximity sensors 51 to 53 is formed as a detection surface for detecting the magnetism of the permanent magnet 56.

The permanent magnet 56 is fitted on the outer periphery of the connection portion 32 of the piston 3 in the decompression chamber 7, and has an outer diameter substantially equal to that of the sliding portion 31. The permanent magnet 56 is held by the piston 3 in a state where the lower end surface of the permanent magnet 56 is brought into contact with a step surface 37 between the sliding portion 31 and the connection portion 32 due to the weight of the permanent magnet 56. Accordingly, the permanent magnet 56 reciprocates together with the piston 3.

Figure 7:
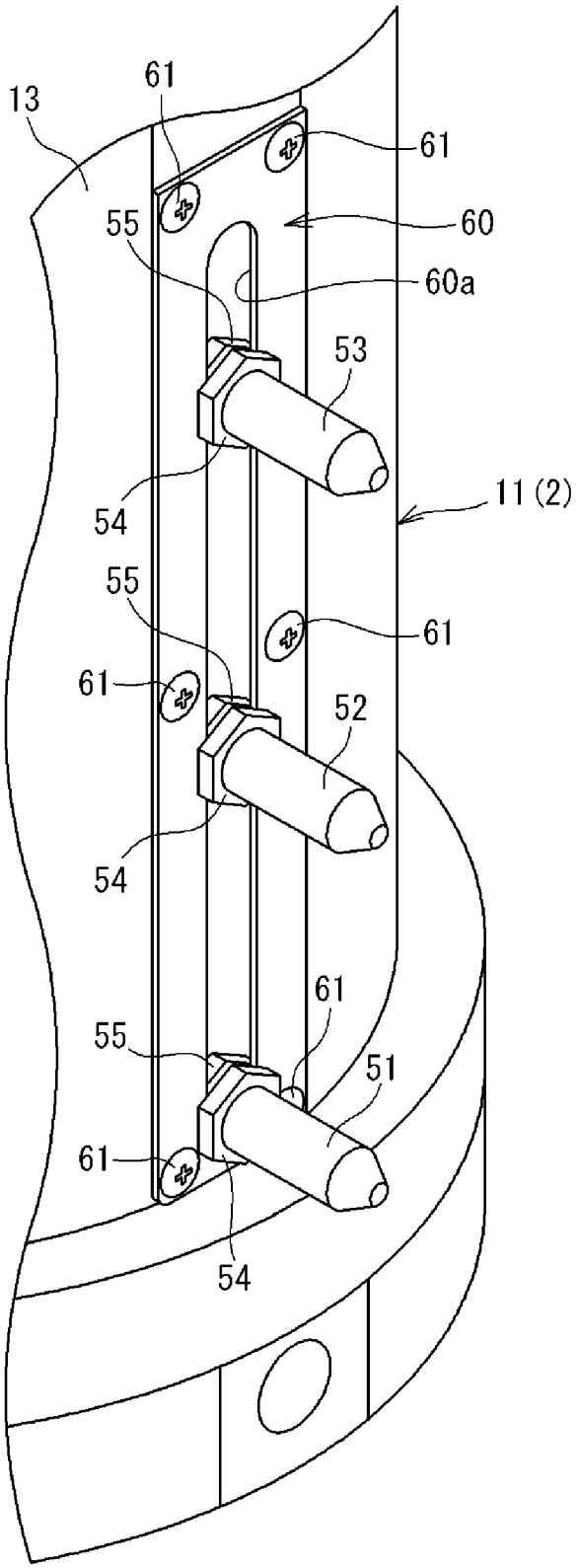
FIG. 7 is an enlarged perspective view of a main part in FIG. 1, showing a structure for mounting proximity sensors.
Figure 8:
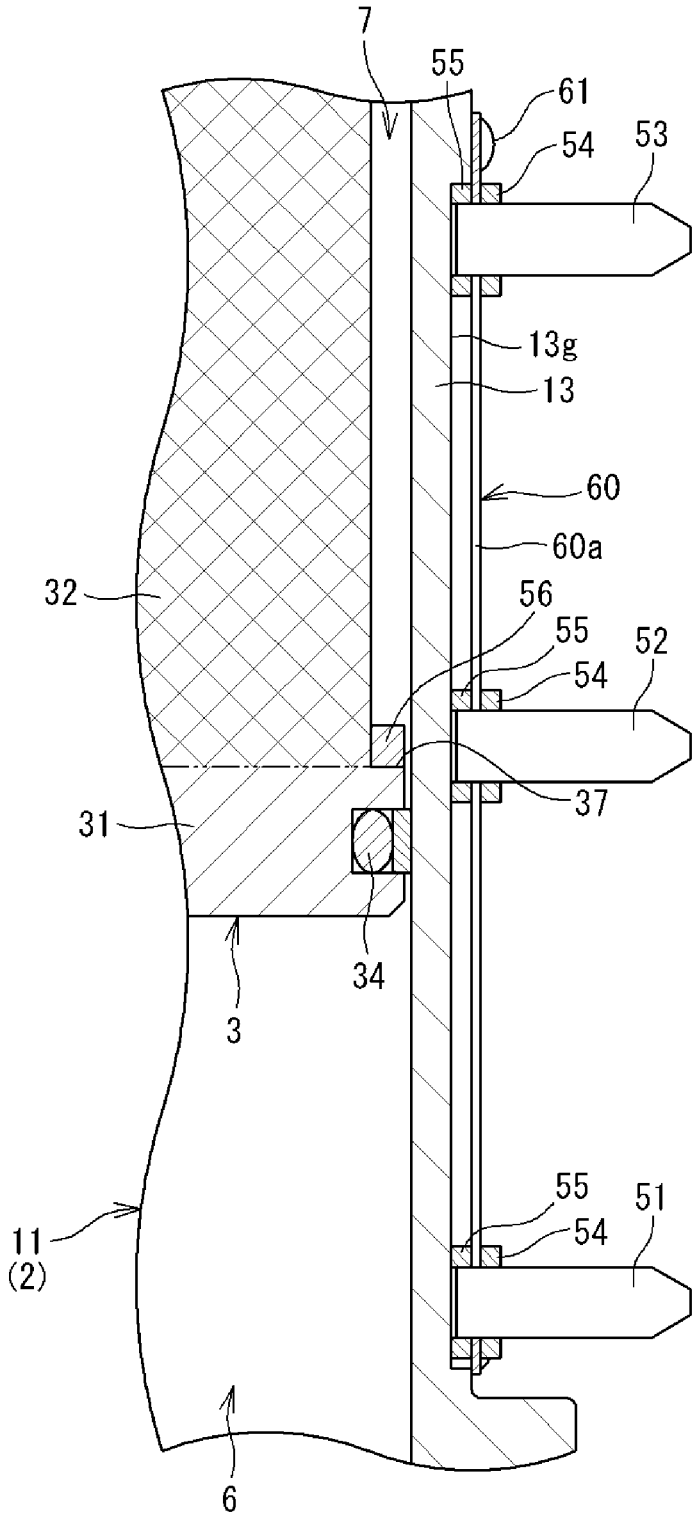
FIG. 8 is an enlarged perspective view of a main part in FIG. 2, showing the structure for mounting the proximity sensors.

FIG. 7 is an enlarged perspective view of a main part in FIG. 1, showing a structure for mounting the proximity sensors 51 to 53. FIG. 8 is an enlarged cross-sectional view of a main part in FIG. 2, showing the structure for mounting the proximity sensors 51 to 53.

In FIG. 7 and FIG. 8, the mounting plate 60 is composed of a rectangular flat plate member, and is detachably mounted on the outer peripheral surface of the cylinder body 13 by a plurality of screws 61 (six in FIG. 7).

A long hole 60*a* is formed in the mounting plate 60 so as to extend in the longitudinal direction of the mounting plate 60 and penetrate in the thickness direction of the mounting plate 60. A pair of nuts 54 and 55 screwed onto an end portion of each of the proximity sensors 51 to 53 at the detection surface side are disposed at the long hole 60*a* in a state where the mounting plate 60 is interposed between the nuts 54 and 55. Accordingly, each of the proximity sensors 51 to 53 is fixed to the mounting plate 60 by tightening the nuts 54 and 55.

A guide groove 13*g* is formed on the outer peripheral surface of the cylinder body 13 so as to extend along the axial direction, and the nut 55 screwed at the outer end in the axial direction of each of the proximity sensors 51 to 53 is fitted into the guide groove 13*g*. Accordingly, rotation of the nut 55 about an axis thereof is restricted.

Therefore, each of the proximity sensors 51 to 53 can be easily fixed to the mounting plate 60 by rotating the nut 54, which is not fitted into the guide groove 13*g*, in the tightening direction. In addition, each of the proximity sensors 51 to 53 is made to become movable along the guide groove 13*g* and the long hole 60*a* by loosening the corresponding tightened nut 54. Accordingly, the mounting position (detection position) of the proximity sensors 51 to 53 with respect to the housing 2 can be individually adjusted.

Figure 9:
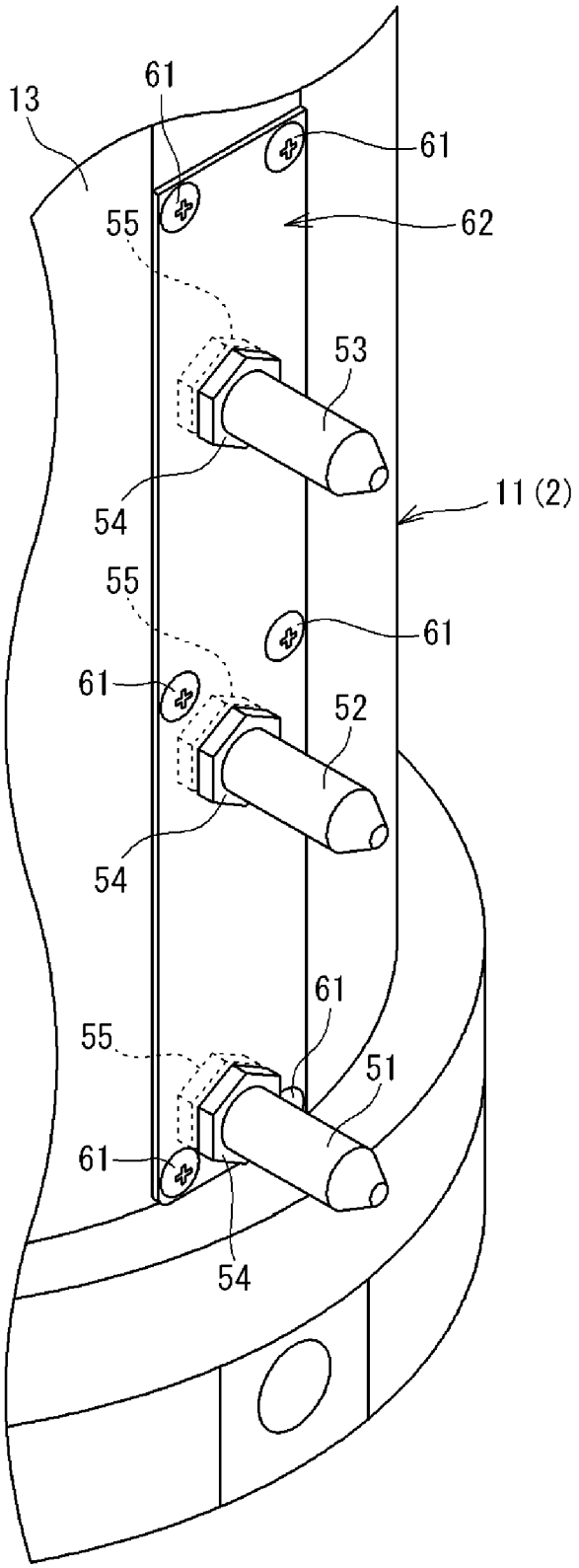
FIG. 9 is an enlarged perspective view showing a modification of the structure for mounting the proximity sensors.

FIG. 9 is an enlarged perspective view showing a modification of the structure for mounting the proximity sensors 51 to 53. In FIG. 9, in the present modification, each of the proximity sensors 51 to 53 is mounted on the outer peripheral surface of the cylinder body 13 of the housing 2 with a mounting plate 62 therebetween such that the position of each proximity sensor cannot be adjusted. Specifically, instead of a long hole, three round holes (not shown) are formed in the mounting plate 62 so as to penetrate in the thickness direction of the mounting plate 62. The end portion of each of the proximity sensors 51 to 53 at the detection surface side is inserted through one of these round holes, and each of the proximity sensors 51 to 53 is fixed to the mounting plate 62 by tightening a pair of nuts 54 and 55 in this state.

Structure of Stopper

Figure 10:
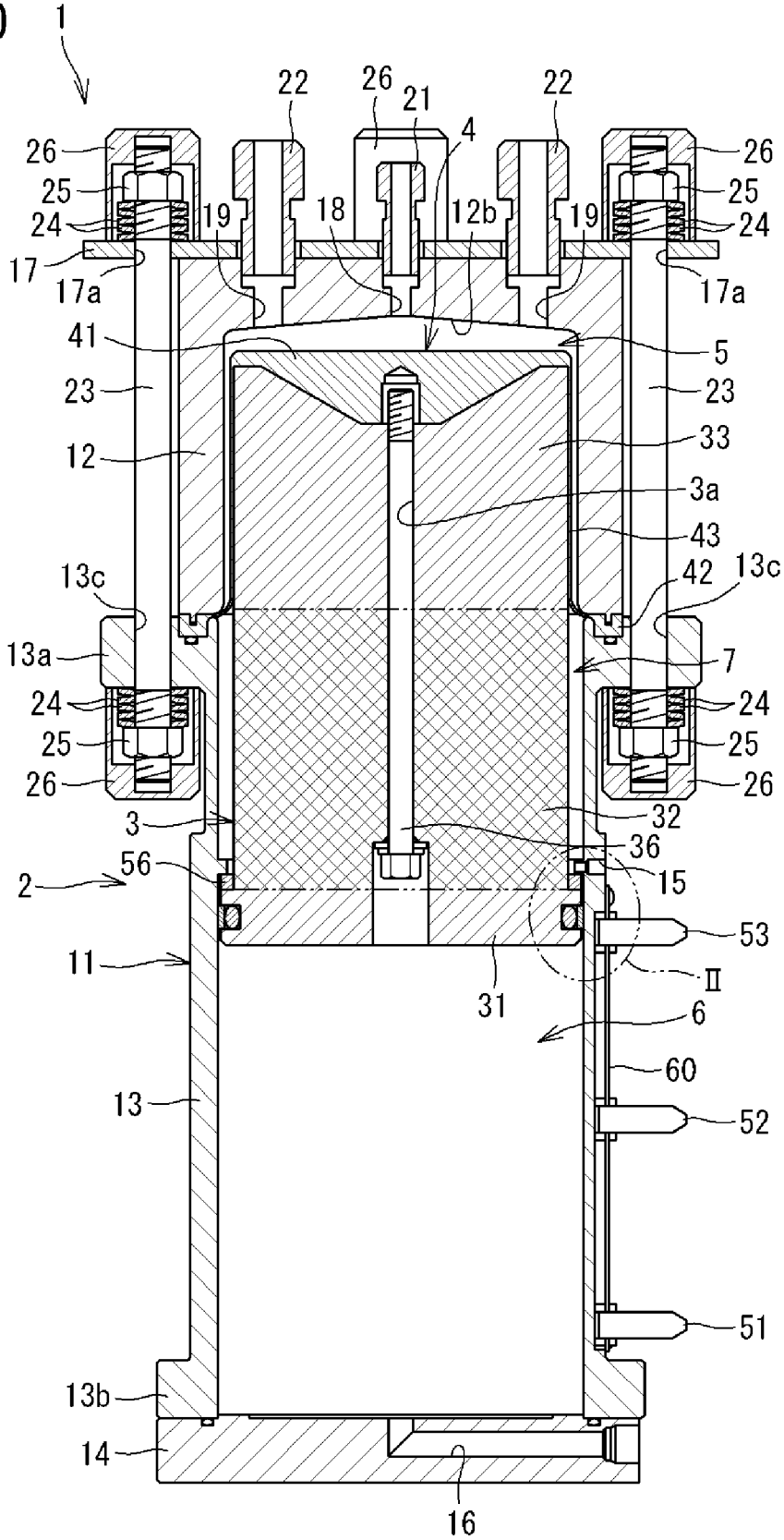
FIG. 10 is a cross-sectional view of the rolling diaphragm pump, showing a state where the piston is at a most advanced position.
Figure 11:
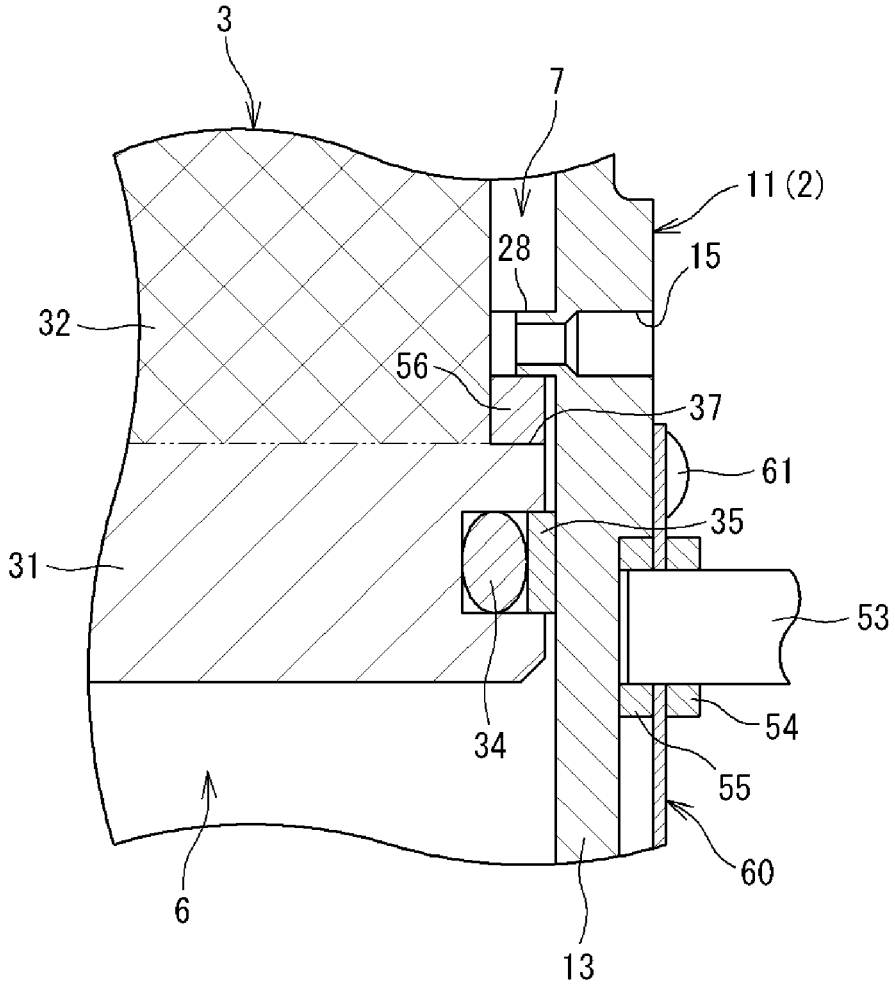
FIG. 11 is an enlarged cross-sectional view of a portion II in FIG. 10.

FIG. 10 is a cross-sectional view of the pump 1, showing a state where the piston 3 is at the most advanced position. FIG. 11 is an enlarged cross-sectional view of a portion II in FIG. 10.

In FIG. 10 and FIG. 11, a stopper 28 for restricting the piston 3 from advancing to the upper side in the axial direction with respect to the most advanced position is provided on the inner peripheral surface of the housing 2. The stopper 28 is used when the piston 3 advances to above the most-advanced-immediately-previous position due to malfunction of the third proximity sensor 53 or the like.

In the present embodiment, the cylinder body 13 has the annular stopper 28 integrally formed on the inner peripheral surface thereof so as to project radially inward. The stopper 28 has an inner diameter larger than the outer diameter of the connection portion 32 of the piston 3 and smaller than the outer diameter of the permanent magnet 56. The stopper 28 is formed on the inner peripheral surface of the cylinder body 13 at a position where the upper end surface of the permanent magnet 56 comes into contact with the lower end surface of the stopper 28 when the piston 3 advances to the most advanced position. The stopper 28 may be provided as a member separate from the cylinder body 13.

Owing to the above configuration, the piston 3 can be restricted from advancing to the upper side in the axial direction with respect to the most advanced position, by the stopper 28. When the piston 3 is located at the most advanced position, the upper surface of the movable portion 41 of the rolling diaphragm 4 is located below a top surface 12*b* within the pump head 12.

Therefore, the upper surface of the movable portion 41 can be prevented from coming into contact with the top surface 12*b* of the pump head 12, by the stopper 28 restricting the piston 3 from advancing to the upper side in the axial direction with respect to the most advanced position. As a result, particles (fine dust), etc., can be inhibited from being generated from the movable portion 41.

In the present embodiment, since the permanent magnet 56 to be detected by the proximity sensors 51 to 53 also serves as a member that comes into contact with the stopper 28, a member that comes into contact with the stopper 28 does not need to be additionally provided at the piston 3 side. Accordingly, the pump 1 can be made with a simple configuration.

At a portion of the cylinder body 13 at which the stopper 28 is formed, the above-described ventilation port 15 is formed so as to penetrate in the radial direction from the outer peripheral surface of the cylinder body 13 toward the inner peripheral surface of the stopper 28. Accordingly, the ventilation port 15 is formed at a portion of the cylinder body 13 that is thick in the radial direction, and thus a decrease in the rigidity of the cylinder body 13 can be inhibited as compared to the case where the ventilation port 15 is formed at a portion of the cylinder body 13 that is thin in the radial direction.

The ventilation port 15 may be formed above the stopper 28 of the cylinder body 13. However, as shown in FIG. 4, when the piston 3 retracts to the most retracted position, the connecting portion 43 of the rolling diaphragm 4 is brought into close contact with the inner peripheral surface 13*d* of the cylinder body 13. Thus, in the case where the ventilation port 15 is formed above the stopper 28 of the cylinder body 13, a length L of the cylinder body 13 from the upper end surface of the stopper 28 to the upper end surface of the cylinder body 13 needs to be longer than that in the present embodiment such that a lower end portion of the connecting portion 43 in the state shown in FIG. 4 is located above the ventilation port 15 without closing the ventilation port 15 by the connecting portion 43.

Therefore, in the case where the ventilation port 15 is formed at the portion of the cylinder body 13 at which the stopper 28 is formed as in the present embodiment, the overall length in the axial direction (up-down direction) of the housing 2 can be shortened as much as possible, as compared to the case where the ventilation port 15 is formed above the stopper 28 of the cylinder body 13.

Others

Figure 12:
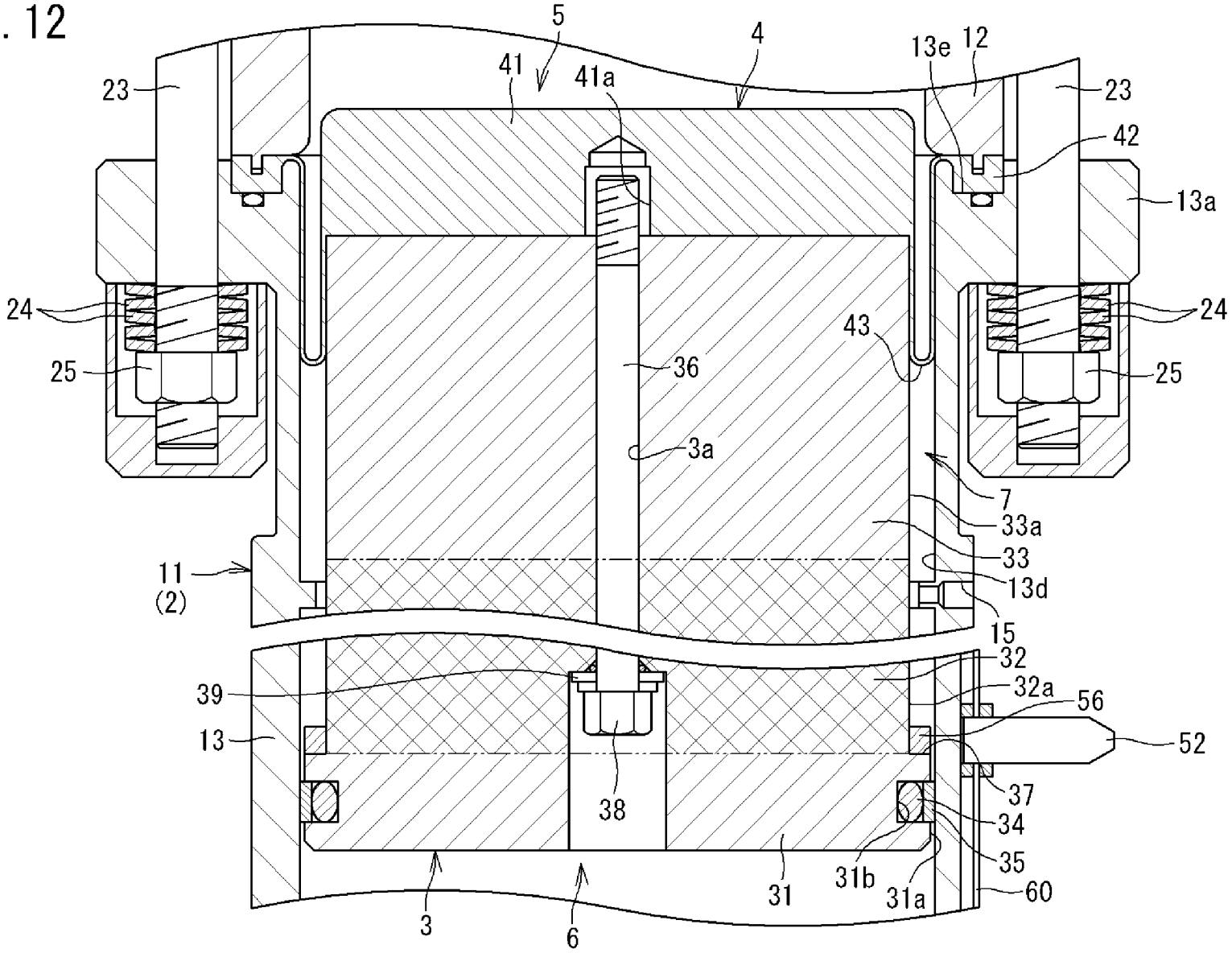
FIG. 12 is a partially enlarged cross-sectional view of a rolling diaphragm pump according to another embodiment of the present invention.
Figure 13:
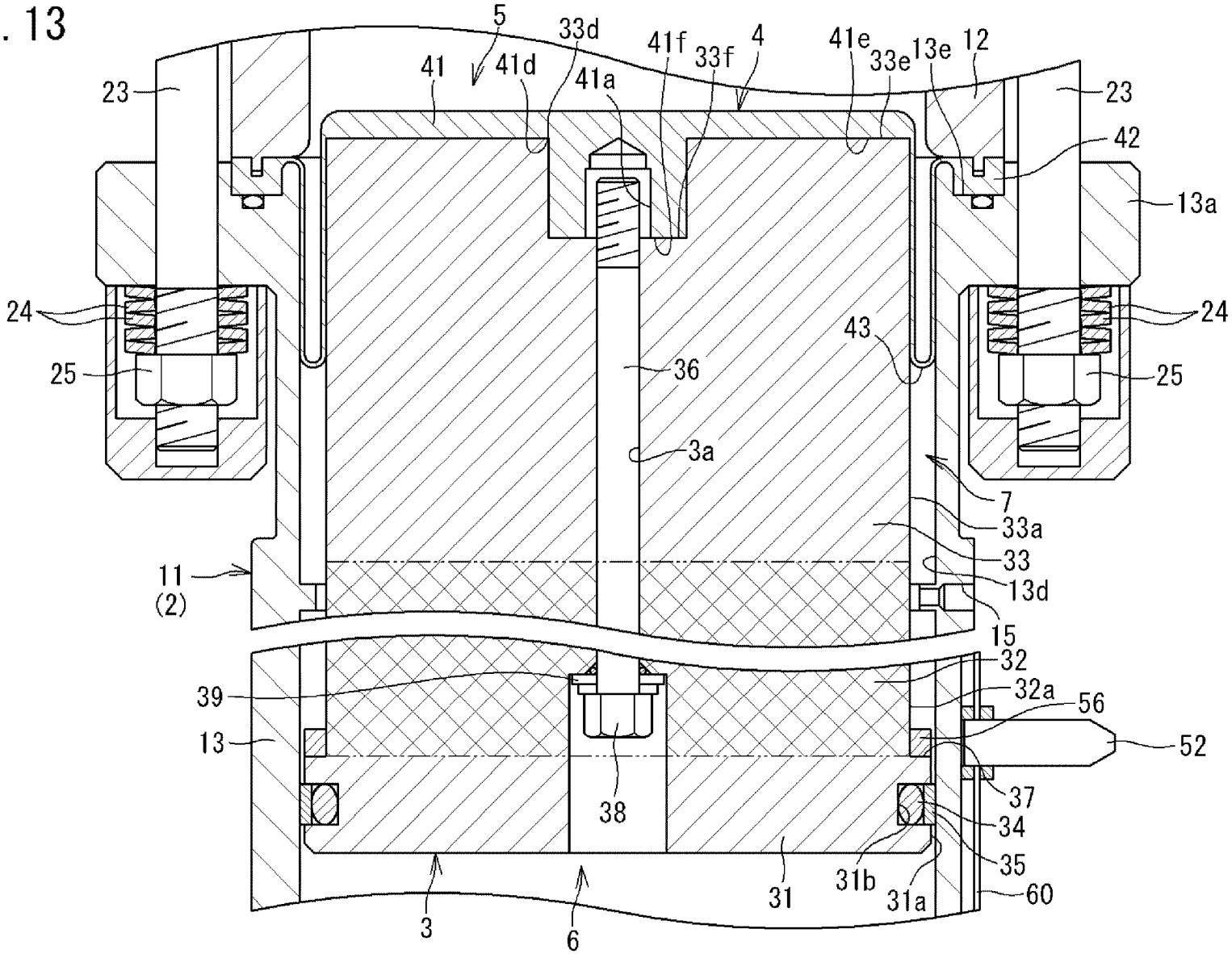
FIG. 13 is a partially enlarged cross-sectional view of a rolling diaphragm pump according to still another embodiment of the present invention.
Figure 14:
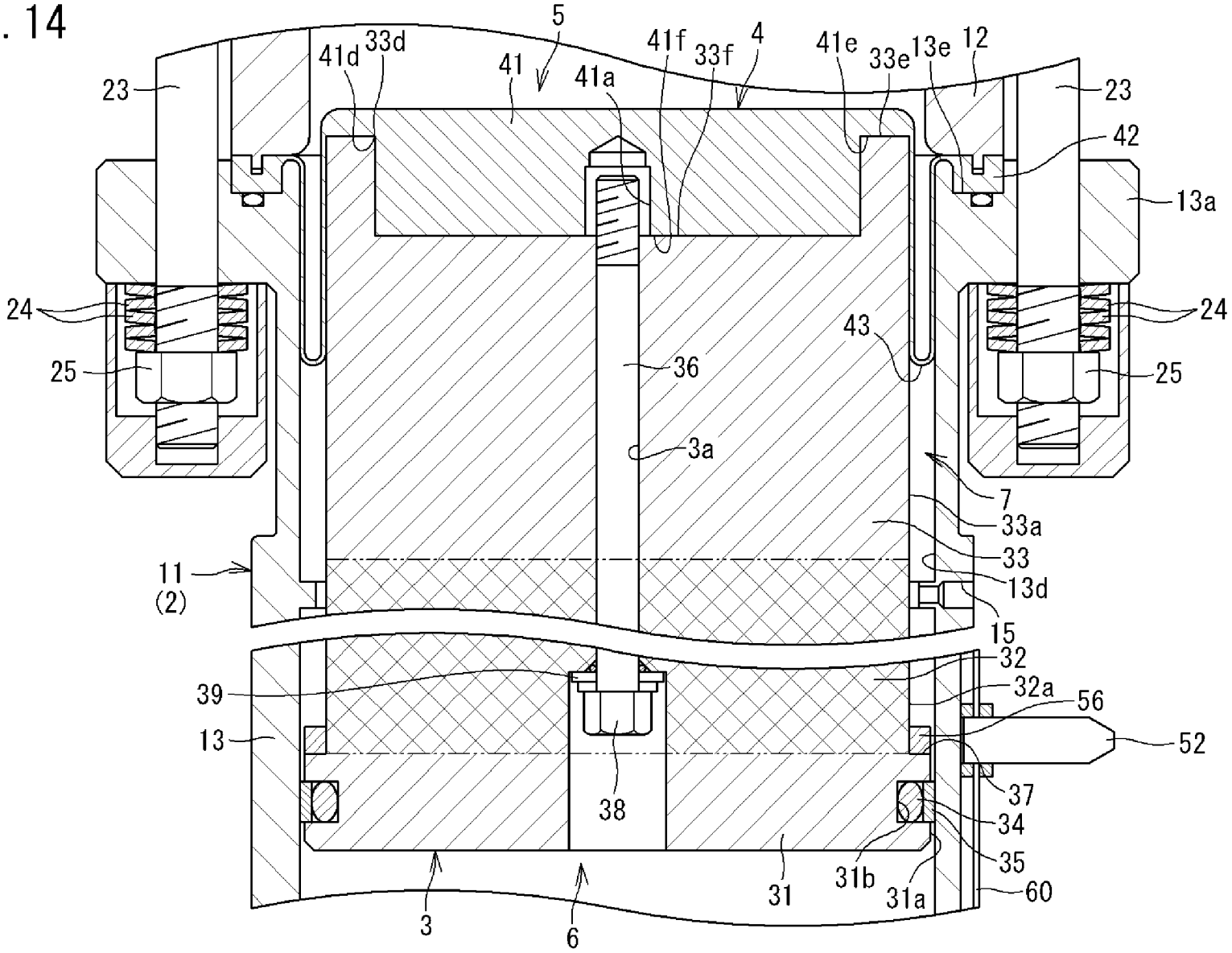
FIG. 14 is a partially enlarged cross-sectional view of a rolling diaphragm pump according to still another embodiment of the present invention.

As the shape of the recess 33*b* of the closely-contacted portion 33 of the piston 3, various variations are conceivable as shown in FIG. 12 to FIG. 14, but the recess 33*b* is preferably formed in a mortar shape as in the present embodiment (see FIG. 3). That is, the piston 3 and the rolling diaphragm 4 are preferably fitted to each other through tapered surfaces 33*c* and 41*c* provided in opposing surfaces of both members (the closely-contacted portion 33 and the movable portion 41). The reason for this is as follows.

A center portion of the movable portion 41 of the rolling diaphragm 4 needs to be thick such that the front end portion of the through bolt 36 can be screwed thereinto.

In the case where the entirety of the movable portion 41 of the rolling diaphragm 4 is made thick as shown in FIG. 12, the length of the connecting portion 43 becomes short, and the variable volume of the pump chamber 5 becomes small (on the other hand, to make the length of the connecting portion 43 equal to that in the present embodiment to ensure the same variable volume of the pump chamber 5 as in the present embodiment, the length L of the cylinder body 13 becomes longer than that in the present embodiment (see FIG. 4), and the overall length in the axial direction (up-down direction) of the housing 2 becomes longer).

In the case where only the center portion of the movable portion 41 of the rolling diaphragm 4 is made suddenly thick as shown in FIG. 13, a load applied from the closely-contacted portion 33 of the piston 3 is concentrated on a corner portion 41*d* (including a chamfered portion) that is a boundary portion of the movable portion 41 (a load is received in a concentrated manner from a corner portion 33*d*), and thus the movable portion 41 may be broken from the corner portion 41*d*. This is because, normally, the piston 3 and the rolling diaphragm 4 are aligned with each other between opposing surfaces 33*e* and 41*e* of outer peripheral portions of both members (the closely-contacted portion 33 and the movable portion 41) and a slight gap is provided between opposing surfaces 33*f* and 41*f* of center portions of both members, but the movable portion 41 is pulled toward the closely-contacted portion 33 side as a whole with a portion around the screw hole 41*a* as a center by screwing the front end portion of the through bolt 36 into the movable portion 41.

Also, in the case where a large part of the movable portion 41 of the rolling diaphragm 4 excluding the outer peripheral portion thereof is made suddenly thick as shown in FIG. 14, similar to the case shown in FIG. 13, a load applied from the closely-contacted portion 33 of the piston 3 is concentrated on the corner portion 41*d*, and thus the movable portion 41 may be broken from the corner portion 41*d*.

Therefore, in the present embodiment (see FIG. 3), the upper surface of the closely-contacted portion 33 (the inner peripheral surface of the recess 33*b*) is formed as the tapered surface 33*c* having an inner diameter increasing toward the upper side in the axial direction such that a load applied from the closely-contacted portion 33 of the piston 3 to the movable portion 41 of the rolling diaphragm 4 is not concentrated on the corner portion 41*d* (including the case of being chamfered). In addition, the lower surface of the movable portion 41 is formed as the tapered surface 41*c* having an outer diameter increasing toward the upper side in the axial direction such that the thickness of the movable portion 41 gradually decreases from the center portion toward the outer peripheral portion. The piston 3 and the rolling diaphragm 4 are fitted to each other through the tapered surfaces 33*c* and 41*c* of both members (the closely-contacted portion 33 and the movable portion 41).

The embodiments disclosed herein are merely illustrative in all aspects and should be considered not restrictive. The scope of the present invention is defined by the scope of the claims rather than the meaning described above, and is intended to include meaning equivalent to the scope of the claims and all modifications within the scope.

REFERENCE SIGNS LIST

1 rolling diaphragm pump
2 housing
3 piston
4 rolling diaphragm
5 pump chamber
6 working fluid chamber
31 sliding portion
32 connection portion
33 closely-contacted portion
41 movable portion
42 fixed portion
43 connecting portion

The invention claimed is:

1. A rolling diaphragm pump comprising:

a housing;

a piston disposed so as to be slidable relative to an inner peripheral surface of the housing and reciprocatable in an axial direction of the housing;

a rolling diaphragm having a movable portion disposed at one end portion in the axial direction of the piston and reciprocatable together with the piston, a fixed portion fixed to the housing, and a flexible connecting portion connecting the movable portion and the fixed portion to each other;

a pump chamber defined by the rolling diaphragm at one side in the axial direction within the housing and into and from which a transport fluid is sucked and discharged by changing a volume of an interior of the pump chamber by deformation of the connecting portion due to reciprocation of the piston;

a working fluid chamber defined by another end portion in the axial direction of the piston at another side in the axial direction within the housing and into and from which a working fluid is supplied and discharged, thereby causing the piston to reciprocate, wherein the piston includes a sliding portion slidable relative to the inner peripheral surface of the housing, a closely-contacted portion having an outer peripheral surface with which the deformed connecting portion can be brought into close contact, and a connection portion connecting the sliding portion and the closely-contacted portion to each other;

a decompression chamber whose pressure is reduced to a predetermined pressure is defined, by the sliding portion and the connecting portion, between the inner peripheral surface of the housing and the outer peripheral surface of the piston; and a stopper projecting into the decompression chamber and configured to restrict movement of the sliding portion to the one side in the axial direction with respect to a predetermined position is integrally formed on the inner peripheral surface of the housing in the decompression chamber, wherein the stopper includes a ventilation port communicating with the decompression chamber and penetrating from an outer peripheral surface of the housing toward an inner peripheral surface of the stopper.

2. The rolling diaphragm pump according to claim 1, wherein the sliding portion, the closely-contacted portion, and the connection portion are formed as a single member.

3. The rolling diaphragm pump according to claim 1, wherein the stopper has a shorter axial length than the sliding portion.

4. The rolling diaphragm pump according to claim 1, further comprising:

a permanent magnet attached to an outer periphery of the connection portion and configured to reciprocate together with the piston; and a proximity sensor provided on the outer peripheral surface of the housing and configured to detect a magnetism of the permanent magnet, wherein the stopper is formed on the inner peripheral surface of the housing, at a position where the permanent magnet comes into contact with the stopper when the piston moves to the predetermined position.

5. The rolling diaphragm pump of claim 1, wherein the movable portion of the rolling diaphragm is fitted into a recess of the closely-contacted portion of the piston through tapered surfaces provided in opposing surfaces of the movable portion and the closely-contacted portion.

* * * * *